United States Patent [19]

Stieringer

[11] 3,978,370

[45] Aug. 31, 1976

[54] ELECTRONIC FLASH UNIT

[75] Inventor: Albert Stieringer, Weil der Stadt, Germany

[73] Assignee: Robert Bosch G.m.b.H., Stuttgart, Germany

[22] Filed: Nov. 11, 1974

[21] Appl. No.: 522,944

Related U.S. Application Data

[63] Continuation of Ser. No. 357,338, May 4, 1973, abandoned.

[30] Foreign Application Priority Data

May 6, 1972 Germany ..... 2222412

[52] U.S. Cl. ..... 315/151; 315/159; 315/241 P

[51] Int. Cl.² ..... H05B 37/02

[58] Field of Search ..... 315/151, 159, 241 P

[56] References Cited

UNITED STATES PATENTS

| | | | |
|---|---|---|---|
| 3,519,879 | 7/1970 | Ogawa | 315/151 |
| 3,541,387 | 11/1970 | Ackermann | 315/151 |
| 3,683,233 | 8/1972 | Heintze | 315/241 P X |
| 3,758,822 | 9/1973 | Wilwerding | 315/241 P |

*Primary Examiner*—R. V. Rolinec
*Assistant Examiner*—Lawrence J. Dahl
*Attorney, Agent, or Firm*—Michael J. Striker

[57] ABSTRACT

Operation of the release contact causes a capacitor in the light measuring circuit to be connected to the D.C. supply. The voltage across the capacitor is applied to the gate of a thyristor in the ignition circuit. Only when the voltage across the capacitor has reached a value for proper operation of the exposure control circuit which terminates the flash, is sufficient voltage applied to the gate of the thyristor in the ignition circuit to cause it to fire, thereby causing the flashtube to ignite.

5 Claims, 1 Drawing Figure

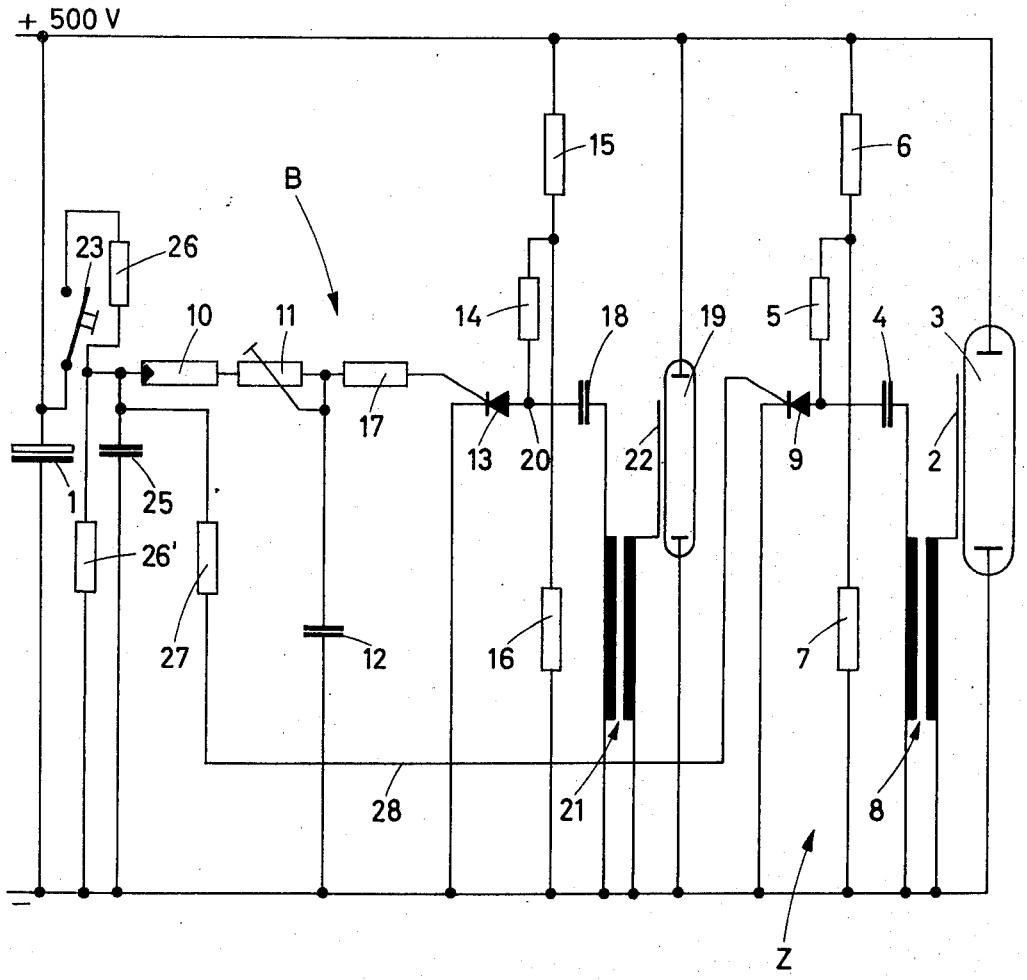
+ 500 V
B
15
6
23
26
10
11
14
18
19
5
4
3
17
13
20
22
9
2
1
25
26'
27
12
16
7
28
21
8
Z

ELECTRONIC FLASH UNIT

This is a continuation, of application Ser. No. 357,338, filed 05/04/1973, now abandoned.

BACKGROUND OF THE INVENTION

The present invention relates to an electronic flash unit. Particularly, it relates to an electronic flash unit for use in a photographic process wherein the flashtube is ignited upon operation of a synchronous switch coupled to the shutter of the camera and wherein exposure control means are furnished which terminate the flash when a predetermined exposure of the film has been reached.

More particularly, the present invention relates to flash units wherein the exposure control circuit is activated substantially simultaneously with the initiation of the flash, so that the effect of external flashes or of light which falls upon the exposure control circuit prior to the initiation of the flash is eliminated. One field of application of such an electronic flash unit is in conjunction with a camera. When so used, it operates as follows: The light from the light flash is reflected by the object to be photographed. The reflected light is applied to the film through the optical system of a camera. Simultaneously, it is applied to a photoelectric transducing element which is a part of the exposure control circuit. The photoelectric transducing element furnishes an electric current which corresponds to the light impinging thereon.

This current is integrated, for example by a capacitor, the voltage across the capacitor then constituting a measure of the total quantity of reflected light. If the voltage across the capacitor has reached a predetermined value which corresponds to the optimum film exposure, the circuit acts to terminate the flash.

In such equipment it is of course obvious that if the exposure control means are operative immediately upon energization of the equipment and prior to the time that the flash is to be initiated, then the exposure control means will react to integrate ambient light or light emanating from flashes other than the flash of the particular flash unit. The integration of the current corresponding to this light causes an initial voltage to appear across the capacitor which serves to furnish the terminating signal. Of course an incorrect exposure will then result, since the light furnished by the flash of the unit will be less than that required for optimum exposure. Particularly large errors can be introduced by external flashes which, when directed to impinge on the photoelectric element in the exposure control circuit will have a far greater effect then even the flash of the particular unit. When the circuit terminating the flash contains a quench tube which is connected in parallel with the flashtube and short-circuits same after the voltage across the above-mentioned capacitor has reached the proper voltage for exposure, then such a foreign flash can cause an ignition of the quench tube and a resulting discharge of the storage capacitor, so that the equipment will not be ready to furnish a flash.

Various methods are known wherein the exposure control circuit is not activated until after the ignition pulse has been furnished for the flash tube or until after the flash has actually occurred. Thus the voltage across a capacitor which constitutes the operating voltage for the exposure control circuit is derived either from the flow of ignition current or from the flow of current through the flashtube itself after ignition, or, alternatively, a light sensitive element can be used which, upon receipt of light from the flashtube connects the exposure control circuit to the proper operating voltage.

The above circuits have in common that the light resulting from the beginning of the flash may not be properly evaluated by the exposure control circuit, since this circuit may not be properly operative at that time.

SUMMARY OF THE INVENTION

It is an object of the present invention to furnish an electronic flash unit wherein the flash is properly terminated at the correct exposure and wherein the flash is not ignited until such time as the exposure control circuit is in proper operating condition.

In accordance with the present invention, an electronic flash unit has flashtube means for generating a flash in response to an ignition signal. It further has ignition circuit means for furnishing said ignition signal upon receipt of a control signal. Further furnished are exposure control means terminating the flash when the exposure has reached a predetermined light quantity, said exposure control means being operative when a predetermined signal appears at a predetermined circuit point. Means are provided for connecting said predetermined circuit point to said ignition circuit means in such a manner that said predetermined signal constitutes said control signal for said ignition circuit means. Further comprised in the present invention is a source of electrical energy and release contact means operable to directly connect said exposure control means to said source of electrical energy.

It is seen that the above system assures in an extremely simple manner that no externally applied light prior to the initiation of the flash will affect the exposure time. Further it will be noted that really no additional components over and above those required for the exposure control circuit and the ignition circuit are required to effect the desired result. Thus the exposure control circuit is directly connected to the D.C. supply source upon activation of the synchronous contact of the camera shutter and the ignition circuit then operates when the voltage at a predetermined point in the exposure control circuit indicates that this circuit is ready for operation. The exposure control circuit is thus most definitely ready to operate properly upon initiation of the flash.

Of course a great many embodiments of the present invention are possible. In a particularly preferred embodiment a capacitor is used to furnish the operating voltage for the light measuring means and the voltage across the capacitor is applied to the gate of an electronic flash in the ignition circuit, the circuit being so-dimensioned that application of the proper operating voltage for the exposure control circuit results in switching the electronic switch from a blocked to a conductive state, thereby initiating the flash.

In a particularly preferred embodiment of the present invention the electronic switch is a thyristor whose gate is connected with the above-mentioned capacitor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE is a schematic circuit diagram of a preferred embodiment of the present invention.

DESCRIPTION OF THE PREFERRED EMBODIMENT

A preferred embodiment of the invention will now be described with reference to the drawing.

In the single FIGURE, reference numeral 1 denotes a storage capacitor which is charged to approximately 500 volts a few seconds after the equipment is first energized. This storage capacitor serves to provide the electrical energy required for flashtube 3. Flashtube 3 has an ignition electrode 2.

An ignition circuit for flashtube 3, marked Z in the drawing, comprises an ignition capacitor 4 which has one terminal connected through a resistor 5 to the tap of a voltage divider having resistors 6 and 7 connected in parallel with the 500 volt source. The other terminal of capacitor 4 is connected through the primary winding of an ignition transformer 8 to ground potential. Thus the ignition capacitor is charged to a voltage corresponding to the voltage divider ratio of resistors 6 and 7 following energization of the flash unit.

Further, electronic switch means, here a thyristor 9 have an anode-cathode circuit connected from the first-mentioned terminal of capacitor 4 to ground potential. When a voltage is applied at the gate of this thyristor, it switches from a blocked to a conductive state causing capacitor 4 to discharge through the primary winding of transformer 8, thereby inducing a pulse in the secondary winding which acts as an ignition pulse for flashtube 3, thereby initiating the flash.

Further, the electronic flash unit comprises an automatic exposure control circuit labelled B in the drawing whose object it is to terminate the flash when the light reflected from the object to be photographed indicates that the correct exposure has been reached. This statement of course applies when the electronic flash unit is used in conjunction with a camera. When it is used for other photographic processes, the object of the exposure control circuit is to terminate the flash whenever the particular desired exposure has been reached.

The exposure control circuit is a conventional circuit and comprises a photosensitive element 10, for example a photoresistor, a variable resistor 11 connected in series with said photoresistor and a capacitor 12 connected from the other terminal of resistor 11 to ground potential. The capacitor 12 serves to integrate the current in the circuit, which current is proportional to the light falling on photoresistor 10. The voltage across capacitor 12 is thus indicative of the total quantity of light during the exposure. Specifically, for high illumination intensities, the value of photoresistor 10 is a low resistance value, causing capacitor 12 to charge more rapidly. Thus the voltage across capacitor 12 will reach the predetermined voltage indicating the desired exposure faster when more light falls on photoresistor 10 than when less light falls thereon. Since the termination of the flash takes place when the voltage across capacitor 12 reaches a predetermined value, it will be seen that the exposure time varies inversely with the intensity of light falling upon photoresistor 10. Variable resistor 11 serves to adjust the circuit to the sensitivity of the particular film used.

The exposure control circuit further comprises a thyristor 13 whose gate is connected to the common point of variable resistor 11 and capacitor 12 through a resistor 17. The anode-cathode circuit of thyristor 13 is connected through a resistor 14 to the tap of a voltage divider having resistors 15 and 16 connected in parallel with the 500 volt source. Thyristor 13 is blocked as long as the voltage existing between the gate and cathode of said thyristor is below a predetermined threshold value. The anode-cathode circuit of thyristor 13 is connected in series with a capacitor 18 which serves as an ignition capacitor for a quench tube 19 which is connected in parallel with flashtube 3. Ignition capacitor 18 has one terminal connected to the anode of thyristor 13, while its other terminal is connected to ground potential through the primary winding of an ignition transformer 21. The secondary winding of ignition transformer 21 is connected to the ignition electrode 22 of quench tube 19. Ignition capacitor 18 charges to a voltage determined by the resistance values of resistors 15 and 16 while thyristor 13 is blocked. When thyristor 13 switches to the conductive state, namely when the voltage across capacitor 12 indicates that the predetermined exposure has been achieved, capacitor 18 discharges through the primary winding of transformer 21, thereby igniting flashtube 19 whose internal resistance is considerably less than that of flashtube 3. Ignition of quench tube 19 thus causes the blocking of flashtube 3 and the termination of the flash.

The flash is first initiated by operation of a synchronous contact 23 which is a conventional contact coupled to the camera shutter in such a manner that it closes when the shutter reaches the open position. However, in the present invention, the synchronous contact is not connected to the ignition circuit as is conventional. On the contrary, the synchronous contact has one terminal connected to storage capacitor 1 and the other terminal connected through a resistor 26 to one terminal of a capacitor 25 whose other terminal is connected to ground potential. Capacitor 25 serves to supply the operating voltage to an exposure control circuit. Specifically, the exposure control circuit is operative when a predetermined voltage, herein also referred to as a voltage having a second voltage value appears across capacitor 25 or, alternatively, at the terminal of capacitor 25 which is not connected to ground potential. Further, a resistor 26' is connected in parallel with capacitor 25, resistors 26 and 26' serving as a voltage divider so that the correct operating voltage for the exposure control circuit will appear across capacitor 25 after a time constant determined by resistors 26, 26' and capacitor 25. It will be noted that this time constant in no way interferes with proper operation of the equipment, since the flash will not be ignited until capacitor 25 is properly charged.

The positive terminal of capacitor 25, that is the above-mentioned terminal which is not connected to ground potential, is connected via a protective resistor 27 and a line 28 to the gate of thyristor 9. Thyristor 9 becomes conductive upon application of a control signal, that is when the voltage across capacitor 25 exceeds a predetermined voltage herein referred to as a voltage having a third voltage value. Thus the thyristor becomes conductive causing a pulse of current to appear in the primary winding of transformer 8 and therefore in its secondary winding, thereby igniting the flashtube only when the voltage across capacitor 25 is sufficient to assure correct operation of the exposure control circuit.

As described above, the light falling upon photoresistor 10, which may be the light reflected by the object to be photographed, causes a change in the resistance of photoresistor 10 and the corresponding current flow charges capacitor 12. When the voltage across capacitor 12 has reached a predetermined voltage indicative of proper exposure, the control signal at the gate of thyristor 13 is sufficient to cause thyristor 13 to switch to the conductive state. This causes capacitor 18 to discharge through the primary winding of transformer 21, thereby inducing a current pulse in the secondary winding. This current pulse serves as an ignition pulse for quench tube 19, thereby terminating the flash as described above.

It should be noted that the main idea of the present invention is that the ignition circuit for the flashtube is not activated until such time as the exposure control circuit is properly operative. In the embodiment shown herein, this has been accomplished by using the synchronous contact to apply the voltage to a capacitor which was previously discharged, the voltage across the capacitor then constituting the operating voltage for the exposure control circuit. It would of course be equally possible to connect the synchronous contact in parallel with a capacitor, thereby short-circuiting the capacitor until activation of the contact. When the contact opens the voltage would then appear across the capacitor in the same manner in which it appears in the presently shown embodiment upon closure of contact 23.

While the invention has been illustrated and described as embodied in a particular circuit for causing ignition of the flashtube only after the exposure control circuit is properly operative, it is not intended to be limited to the details shown, since various modifications and circuit changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An electronic flash unit comprising, in combination, a flash element; terminating means operative when triggered for terminating a flash being produced by the flash element; a timing circuit operative when activated for measuring the amount of light reflected back toward the unit from objects being illuminated by the unit and when such amount reaches a predetermined value triggering the terminating means; activating means operable for activating the timing circuit; and igniting means for detecting activation of the timing circuit by detecting the occurrence of a predetermined electrical change within the timing circuit and in dependence upon such detection igniting the flash element.

2. The electronic flash unit defined in claim 1, the timing circuit including energy-storing means operative for receiving and storing electrical energy and for supplying such electrical energy to the remainder of the timing circuit, the activating means comprising means for activating the timing circuit by effecting transfer of energy to the energy-storing means thereof, the igniting means comprising means operative for detecting the accumulation of a predetermined amount of electrical energy by the energy-storing means of the timing circuit.

3. The electronic flash unit defined in claim 2, the energy-storing means of the timing circuit being a storage capacitor, the means for effecting the transfer of energy to the energy-storing means comprising means for charging the storage capacitor, the means for detecting the accumulation of a predetermined amount of electrical energy by the energy-storing means comprising means responsive to the voltage across the storage capacitor.

4. The electronic flash unit defined in claim 1, the igniting means including electronic switch means operative when rendered conductive for connecting the flash element to a voltage source, the igniting means furthermore including means for rendering the electronic switch means conductive in dependence upon the detection of the predetermined electrical change within the timing circuit.

5. The electronic flash unit defined in claim 4, the electronic switch means being comprised of a controllable silicon diode having a control electrode and two main electrodes, connected between the voltage source and the flash element, the means for rendering the electronic switch means conductive comprising means operative for applying a forward-bias voltage to the control electrode of the controllable silicon diode in response to the detection of the predetermined electrical change within the timing circuit.

* * * * *